US009341426B1

(12) United States Patent
Larson, Jr.

(10) Patent No.: US 9,341,426 B1
(45) **Date of Patent: *May 17, 2016**

(54) MUZZLE BRAKE FOR FIREARM

(71) Applicant: Rock River Arms, Inc., Colona, IL (US)

(72) Inventor: Lester C. Larson, Jr., Colona, IL (US)

(73) Assignee: Rock River Arms, Inc., Colona, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/957,038

(22) Filed: Dec. 2, 2015

Related U.S. Application Data

(63) Continuation of application No. 14/591,718, filed on Jan. 7, 2015, now Pat. No. 9,207,034.

(60) Provisional application No. 61/925,065, filed on Jan. 8, 2014.

(51) Int. Cl.
*F41A 21/00* (2006.01)
*F41A 21/36* (2006.01)
*F41A 3/66* (2006.01)

(52) U.S. Cl.
CPC .. *F41A 21/36* (2013.01); *F41A 3/66* (2013.01)

(58) Field of Classification Search
CPC ..... F41A 21/26; F41A 21/28; F41A 21/30; F41A 21/32; F41A 21/325; F41A 21/34; F41A 21/36; F41A 21/38; F41A 21/40; F41A 21/42
See application file for complete search history.

(56) References Cited

U.S. PATENT DOCUMENTS 1,605,393 A * 11/1926 Cutts, Jr. ..... F41A 21/36 89/14.3
1,636,357 A * 7/1927 Cutts, Jr. ..... F41A 21/36 89/14.3
2,206,568 A * 7/1940 Hughes ..... F41A 21/36 89/14.3
2,212,684 A * 8/1940 Hughes ..... F41A 21/36 89/14.3
3,161,979 A 12/1964 Lowe
4,322,999 A * 4/1982 Aston ..... F41A 21/36 89/14.3
4,545,285 A * 10/1985 McLain ..... F41A 21/36 89/14.3
4,869,151 A * 9/1989 Chahin ..... F41A 21/36 181/223
4,879,942 A * 11/1989 Cave ..... F41A 21/36 89/14.3
5,279,200 A * 1/1994 Rose ..... F41A 21/32 42/97
5,367,940 A * 11/1994 Taylor ..... F41A 21/36 89/14.3
5,675,107 A * 10/1997 Ledys ..... F41A 21/36 89/14.05
5,698,810 A 12/1997 Rose
D716,904 S * 11/2014 Oglesby ..... D22/108
2004/0244571 A1* 12/2004 Bender ..... F41A 21/38 89/14.3
2008/0083321 A1* 4/2008 Dueck ..... F41A 21/36 89/14.3
2011/0271575 A1* 11/2011 Overbeek Bloem .. F41A 21/325 42/90

* cited by examiner

*Primary Examiner* — Gabriel Klein
(74) *Attorney, Agent, or Firm* — Banner & Witcoff, Ltd.

(57) ABSTRACT

A firearm muzzle brake may include a substantially cylindrical hollow first portion having a first end and a second end; a pair of opposed rows of slots extending through the first portion, each row extending axially along a side of the first portion; a pair of rows of ports extending through the first portion, each row extending axially along the first portion above one of the rows of slots; and a second portion having a first end received in the second end of the first portion, a second end, a central aperture extending through the second portion and being in fluid communication with the hollow first portion such that a bullet can pass through the first and second portions.

9 Claims, 5 Drawing Sheets

MUZZLE BRAKE FOR FIREARM

CROSS-REFERENCE TO RELATED APPLICATION

This application is a continuation of U.S. application Ser. No. 14/591,718, filed Jan. 7, 2015, now U.S. Pat. No. 9,207,034, which claims priority to U.S. Provisional Application Ser. No. 61/925,065, filed Jan. 8, 2014, which is incorporated herein by reference.

FIELD

The present invention relates generally to firearms and more particularly to an improved muzzle brake for a firearm that through improved porting and a forcing cone takes advantage of expanding propellant gases from a discharged round to reduce recoil and rise in the firearm.

BACKGROUND

It is known that muzzle brakes are used on firearms to reduce the recoil and rise of the firearm as a round is discharged out of the end of the barrel. Some of the known muzzle brakes use baffles or ports, or a combination of the two, to reduce the recoil. Baffles are relatively larger surfaces with an aperture sized to let the bullet pass through, but limit the amount of gases that can follow it. Ports are holes drilled into the sidewall of the muzzle brake that redirect the expanding gases from the discharged round and use them to produce directed thrust in a particular direction. The benefit of a muzzle brake is that the brake can make the firearm more comfortable to shoot because of reduced recoil, and it allows the operator to keep the muzzle or end of the barrel aimed at a target during multiple shots.

There remains a need, however, for an improved muzzle brake that further reduces firearm rise and recoil, improves accuracy and the operator's ability to keep the muzzle on target during multiple shots.

SUMMARY

The firearm muzzle brake of the invention is disclosed and depicted in the figures, the details and features of which are incorporated into this specification. The firearm muzzle brake may include an outer cylindrical portion and an inner conical portion that may be press-fit and welded to an end of the outer cylindrical portion to form a muzzle brake, as shown in the figures. The inner conical portion is designed to peel away gases from the discharged bullet so as to prevent gas deflection on the bullet as it passes through the muzzle brake, thereby greatly improving accuracy. The muzzle brake includes specifically designed and orientated slots and ports that with the use of the inner conical portion significantly reduce rise, recoil and torque of the muzzle. The muzzle brake may be used on any firearm, including any rifle, carbine, or pistol. The muzzle brake may be sized to be used with any caliber of firearm, including 0.223, 0.30, 0.308, 0.38, 0.40, 0.458, 0.50, 5.56 mm, 6.8 mm, 9 mm, 7.62 mm calibers, and the like.

DESCRIPTION OF THE DRAWINGS

The present invention is illustrated by way of example and not limited in the accompanying figures in which like reference numerals indicate similar elements and in which.

DESCRIPTION OF THE EMBODIMENTS

Figure 1:
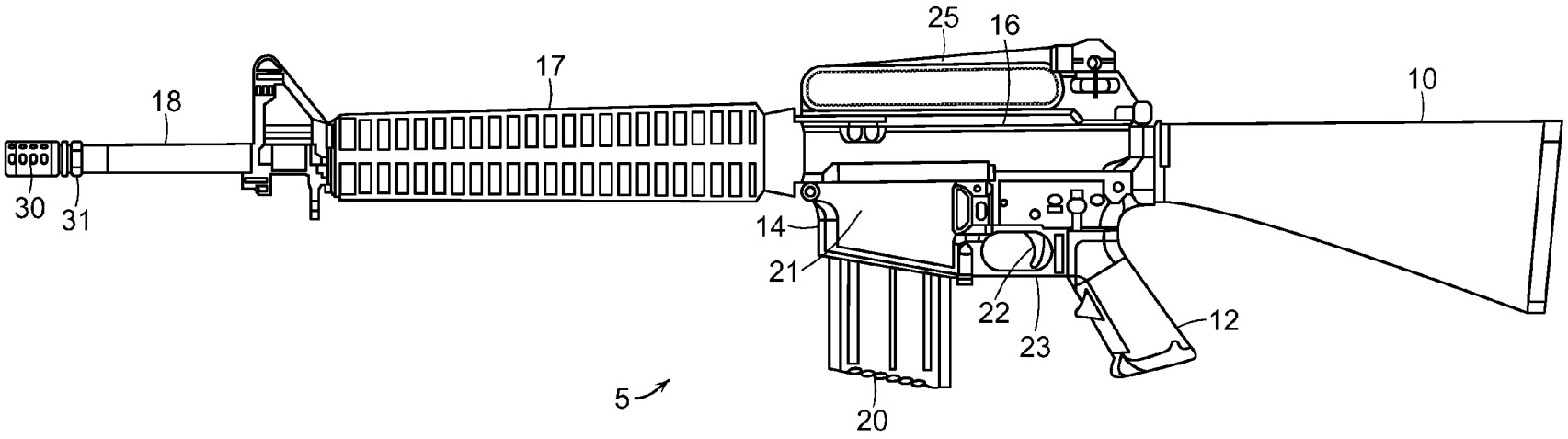
FIG. 1 illustrates a side view of an exemplary firearm.

Referring to FIG. 1, an exemplary firearm 5 may include a lower receiver 14, an upper receiver 16 mounted to the lower receiver, a hand grip 12 mounted to the lower receiver, a handguard 17 mounted around a barrel 18, and a magazine well 21 formed in the lower receiver for receiving a magazine 20. The handguard 17 may be a mid-length handguard, CAR handguard, quad rail handguard, or other handguard. The barrel 18 may be chrome lined, chrome moly, aluminum or other suitable barrel type, and may be rifled or have a smooth bore. The firearm may also include a trigger 22 and a trigger guard 23 that is pinned to the lower receiver and located between the magazine well and the hand grip. In an exemplary embodiment, the trigger may be a two-stage trigger. A stock 10 may be mounted to the back end of upper receiver 16. Stock 10 may be a fixed stock or may be an adjustable stock, such as a six-position tactical stock, or other suitable stock. A picatinny rail, or a carry handle 25, may be included on the top side of upper receiver 16 for mounting iron sights, optics and/or lights. Firearm 5 may be in the form of a rifle, carbine or pistol. Firearm 5 may be chambered in 0.223, 0.30, 0.308, 0.38, 0.40, 0.458, 0.50, 5.56 mm, 6.8 mm, 9 mm, 7.62 mm calibers, and the like.

A firearm muzzle brake 30 as shown and described herein may be used on any firearm, including those described above. Referring to FIGS. 2-13, an exemplary firearm muzzle brake 30 may include an outer cylindrical portion 32 and an inner conical portion 34 that is press-fit and then welded to an end of the outer cylindrical portion, as shown in the figures. It should be understood that in certain embodiments, the outer cylindrical portion and the inner conical portion may be formed as a unitary or monolithic one-piece muzzle brake without the need to join the two components together. Therefore, both embodiments are considered within the scope of the invention.

Outer cylindrical portion 32 defines a generally cylindrical body 40 and a central bore or internal passageway 42 that extends the axial length of body 40. A first end 44 of internal passageway 42 defines a threaded opening 45 (seen in FIGS. 9 and 10) for threadably securing muzzle brake 30 to the threaded muzzle 31 of barrel 18 of firearm 5. A first end 47 of body 40 defines an external tapered surface 46 such that a diameter of first end 47 is less than a diameter of an opposite second end 48 of the outer portion of body 40. Internal axial passageway 42 further defines a pressure chamber 50 (seen in FIGS. 9 and 10) positioned forward of threaded opening 45. Pressure chamber 50 receives discharged gases from the fired round. A plurality of directional ports 52 formed in body 40 connect pressure chamber 50 to an exterior of muzzle brake 30 to vent a portion of the high pressure discharged gases in such a manner as to directionally counter upward and sideward movement of the muzzle 31 when firearm 5 is fired, and to minimize any dust signature. In an alternative aspect, and shown in FIG. 10, a baffle 51 may be positioned within the pressure chamber 50 and immediately forward of the threaded opening 45. The baffle may be annular around the inner wall of the chamber 50 and may serve as contact wall for the discharged gases to counter the recoil forces on the firearm from the discharged round. The baffle also serves to reduce the amount of discharged gases that enter the pressure chamber. The baffle can be considered a first stage brake and the slots 60, described below, can be considered a second stage brake. The two stages serve to greatly reduce the recoil of the firearm, especially for larger caliber firearms.

Figure 4:
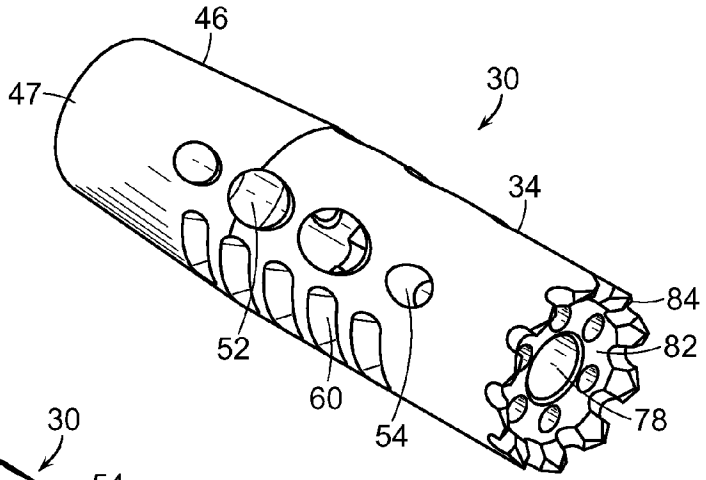
FIG. 4 illustrates an isometric view of the muzzle brake of FIG. 3, after the two main components are welded together.
Figure 5:
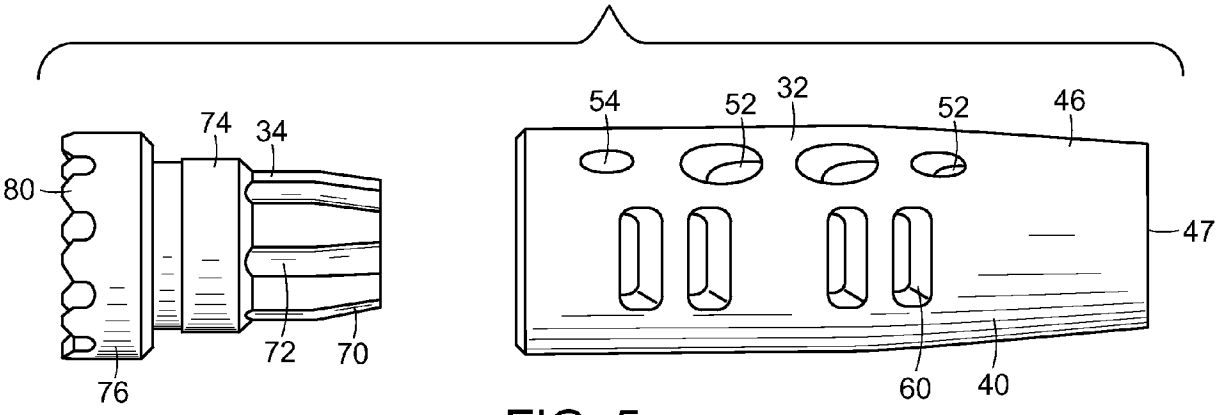
FIG. 5 illustrates a side view of the muzzle brake of FIG. 2 in exploded form.
Figure 6:
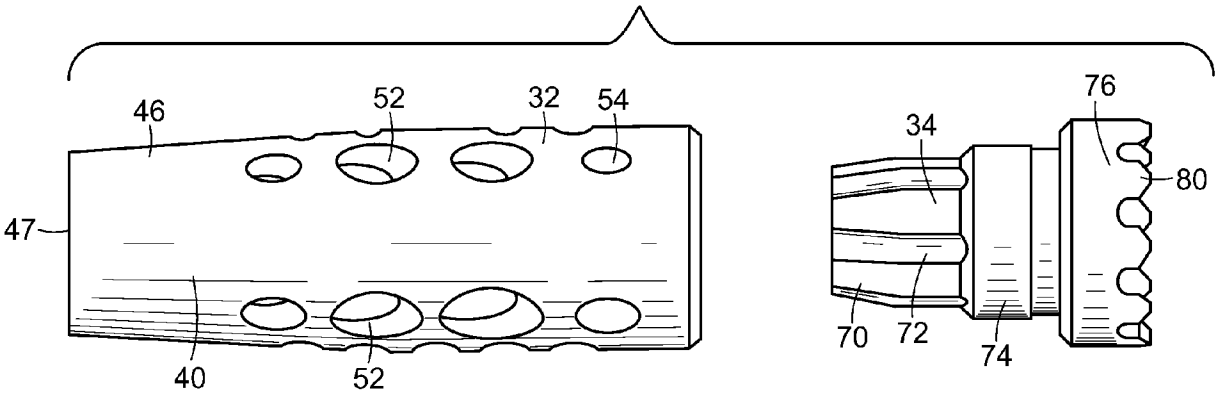
FIG. 6 illustrates another side view of the exemplary muzzle brake of FIG. 2 in exploded form.
Figure 7:
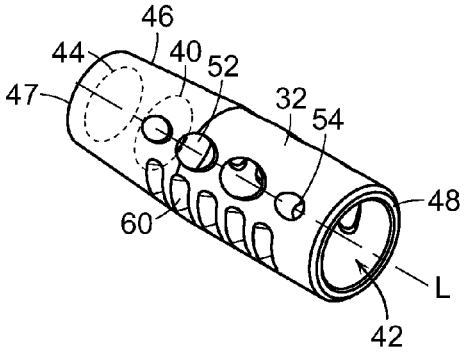
FIG. 7 illustrates an isometric view of the outer cylindrical portion of the muzzle brake of FIG. 2.

As shown in the FIGS. 2-6, ports 52 are arranged in two rows near the top of the outer portion 32. The rows of ports 52 extend in an axial direction along the top of outer portion 32. The two rows of ports 52 are offset from the top of outer portion 32 in an equidistant manner, as shown in FIG. 6. In other words, the centers of each port 52 in each row are positioned the same distance from the top of outer portion 32 when outer portion 32 is attached to muzzle 31 of barrel 18 and barrel 18 is extended horizontally. The gas that vents through ports 52 as shown in the figures will counteract the muzzle lift of firearm 5 when it is fired. In one embodiment, ports 52 may be elliptical in shape, extend in an angular manner through the sidewall of body 40, and may have different sizes.

Figure 10:
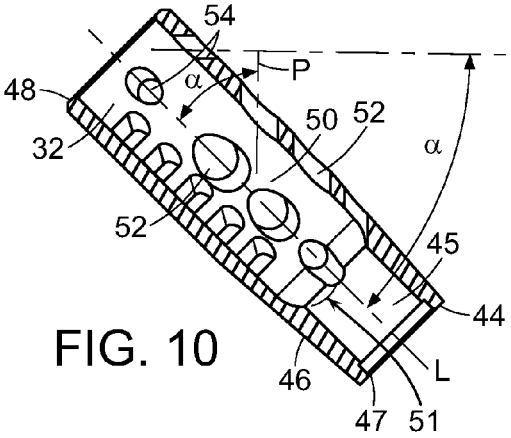
FIG. 10 illustrates another cross-section view of the outer cylindrical portion of FIG. 7.
Figure 11:
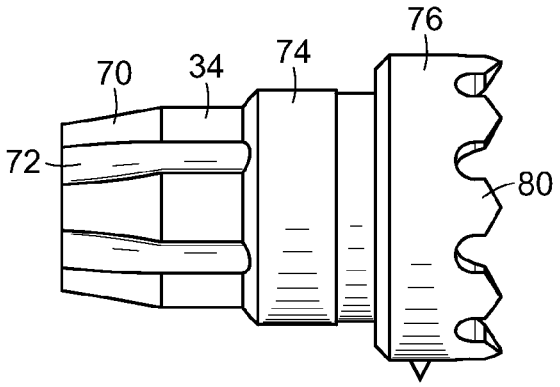
FIG. 11 illustrates a side view of the inner conical portion of the muzzle brake of FIG. 2.
Figure 12:
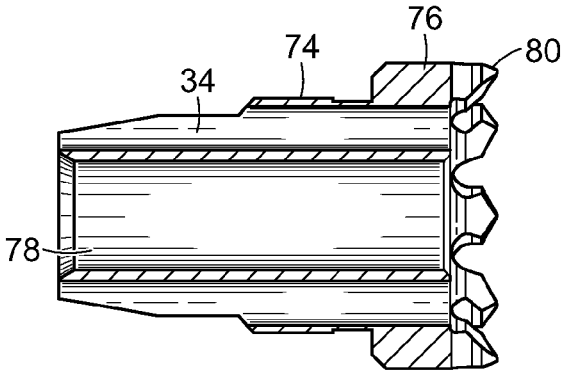
FIG. 12 illustrates a cross-section view of the inner conical portion of FIG. 11.
Figure 13:
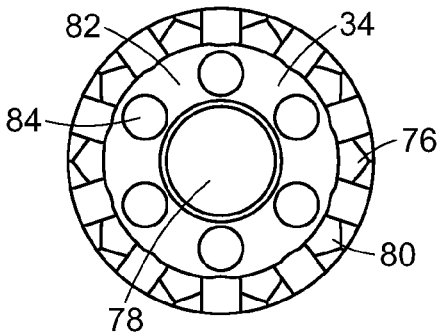
FIG. 13 illustrates an end view of the inner conical portion of FIG. 11.

In certain embodiments, as shown in FIGS. 2-8, each row of ports 52 may include four ports 52 with the two inner ports 52 having a larger diameter than the two outer ports 52. In certain embodiments, ports 52 may be machined into the sidewall of body 40 such that their longitudinal axis P is at an angle $\alpha$ of approximately 45 degrees with respect to a longitudinal axis L of body 40, as shown in FIG. 10. This will create an angled surface in the sidewall of body 40 that will assist in discharging the gases while also assist in directing muzzle brake 30 in a downward direction when firearm 5 is fired.

In another embodiment, as illustrated in FIG. 10, the forward-most port 54 in each row of ports 52 may be machined at an angle of approximately 45 degrees but in a direction that is approximately 90 degrees from the machined direction of the other three ports 52 in the row. In such an embodiment forward-most port 54 is angled rearwardly and outwardly through body 40 toward first end 47 while the other three ports 52 are angled forwardly and outwardly through body 40 toward second end 48. This exemplary arrangement of the ports 52, 54 results in a dramatically improved muzzle brake that prevents rise of the muzzle when firearm 5 is fired.

Figure 8:
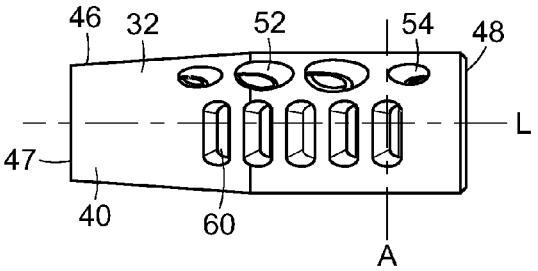
FIG. 8 illustrates a side view of the outer cylindrical portion of FIG. 7.
Figure 9:
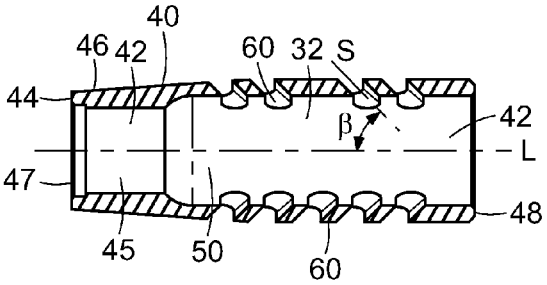
FIG. 9 illustrates a top cross-section view of the outer cylindrical portion of FIG. 7.

Body 40 of outer cylindrical portion 32 may also include a plurality of elongated slots 60 that have a major axis A that extends substantially perpendicular to longitudinal axis L of body 40, as illustrated in FIG. 8. Elongated slots 60 may be spaced apart in the axial direction and may be positioned near the approximate midpoint of the side of body 40 of outer portion 32. Elongated slots 60 may be machined into the sidewall of body 40 of outer portion 32 such that their longitudinal axis S is at an angle with respect to longitudinal axis L, as shown in FIG. 9. In certain embodiments, angle may be approximately 45 degrees.

Elongated slots 60 extend rearwardly and outwardly toward first end 47, and define rearwardly facing surfaces that function as brake surfaces in that when the discharged gases contact the surfaces of elongated slots 60 the force of the gas directs muzzle brake 30 in the direction of the brake surfaces which is opposite of the recoil direction of the firearm 5. In other words, the discharged gases from the fired round exert a force on the rearwardly facing brake surfaces of elongated slots 60 to force muzzle brake 30 in the direction of the fired round which is opposite of the recoil of firearm 5 when the round is fired.

In another embodiment, muzzle brake 30 may include five elongated slots 60 on one side of body 40 of outer portion 32, as shown in FIG. 4, and four elongated slots 60 on the opposite side of body 40 of outer portion 32, as shown in FIG. 5. The additional elongated slot 60 on one side of body 40 of outer portion 32 assists in reducing the side movement of barrel 18 that results from the use of a rifled barrel. A rifled barrel is one that has an internal helical groove machined on the inside of the barrel. This rifling imparts a spin to the bullet as it is fired. This spin serves to gyroscopically stabilize the bullet as it travels, thereby improving the bullet's aerodynamic stability and accuracy. Rifling is often described by its twist rate, which indicates the distance the bullet must travel to complete one full revolution. A shorter distance indicates a faster twist, meaning that for a given velocity the projectile will be rotating at a higher spin rate. This twisting creates a yaw or gyration movement of the bullet as it travels down the barrel and out of the muzzle of the barrel. This also has the effect of causing the barrel to not only rise but also move to the side, sometimes called rifle torqueing. The additional elongated slot 60 on one side of body 40 of outer portion 32 of muzzle brake 30 assists in reducing this side movement of barrel 18 by permitting the discharged gases to act on this additional slot 60 to provide a counteracting force to the side movement resulting from the barrel rifling. The described configuration of slots has been shown to dramatically improve the recoil and undesired movement of the muzzle when the firearm 5 is fired, thereby allowing the operator to better keep the muzzle on target during multiple shots. It is to be appreciated that other configurations of slots are possible with the disclosed muzzle brake 30, including configurations where there is an even number of slots on opposing sides of the outer portion.

Figure 3:
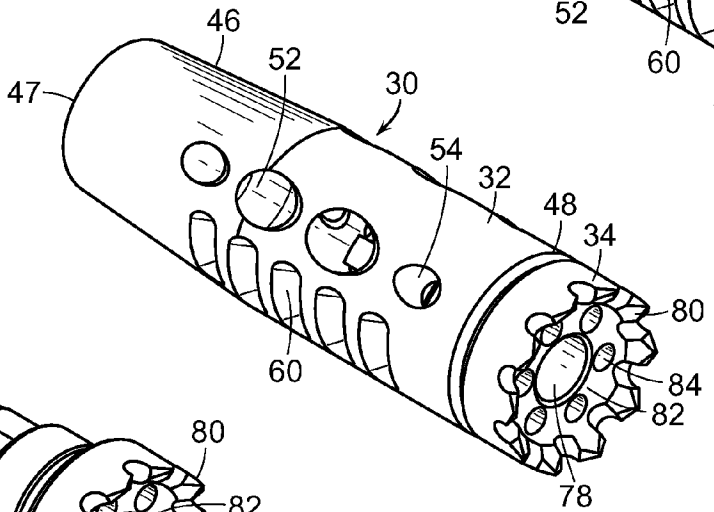
FIG. 3 illustrates an isometric view of the muzzle brake of FIG. 2, after the two main components are press-fit together.
Figure 2:
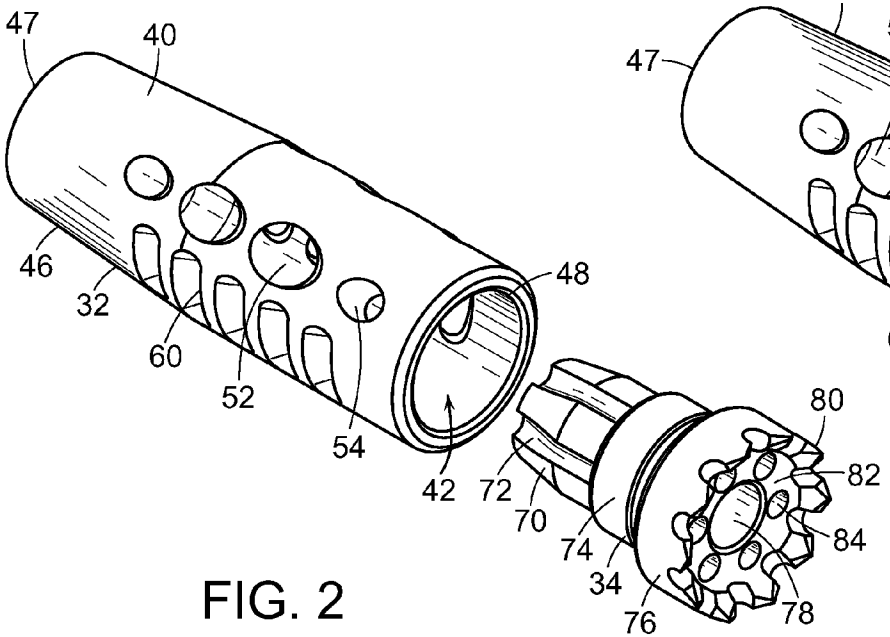
FIG. 2 illustrates an isometric exploded view of an exemplary muzzle brake for use with the firearm of FIG. 1.

As shown in FIGS. 2-4, an exemplary inner conical portion 34 is shown connected to second end 48 of outer cylindrical portion 32. Inner conical portion 34 defines a first conical or tapered end 70 that further defines a plurality of spaced apart channels 72 formed on an outer surface of tapered end 70. The spaced apart channels extend from the first end 70 through a middle portion 74 and out through the apertures 84, as shown in the figures.

Once installed, and in operation, tapered, cone-shaped end 70 directs the discharged gases back toward ports 52, 54 and elongated slots 60 thereby providing further directional control and braking of muzzle brake 30. That is, as the discharged gases contact tapered end 70 of inner conical portion 34, the tapered end 70 redirects the gas in a radially outward direction towards ports 52, 54 and elongated slots 60. This configuration has been shown to dramatically improve the braking effect of muzzle brake 30 and better controls the lift and torqueing of the muzzle when the firearm 5 is fired. Just as significant is the fact that the cone-shaped end 70 serves to peel away the gases from the discharged bullet to prevent gas deflection on the bullet as it passes through the pressure chamber. In operation, when a round is fired there is a tremendous amount of gas pressure that is discharge along with the bullet and out through the muzzle. As the bullet passes through the pressure chamber in the muzzle brake these gases expand rapidly within the chamber and will bounce off the bullet. This gas deflection back on to the bullet affects the trajectory of the bullet and thus the accuracy of the firearm. Each bullet that is affected by gas deflection will have a different trajectory, which is undesirable, especially for competition target shooting and hunting where accuracy is of vital importance. The cone-shaped end 70 is designed and configured to prevent this gas deflection by peeling away the gases that are around the bullet as it passes through the pressure chamber and immediately routes the gases out through the ports and slots. This prevents any gas deflection back on to the bullet and therefore has the significant effect of greatly improving the trajectory of the bullet and the accuracy of the firearm. The cone-shaped end 70, therefore, improves not only the braking effect on the firearm but also greatly improves the firearm's accuracy.

Inner conical portion 34 includes a middle body portion 74 that is sized and shaped to match the interior shape internal passageway 42 of outer portion 32 at its second end 48. Middle body portion 74 is sized and machined to permit inner conical portion 34 to be press fit within internal passageway 42 at second end 48 of outer portion 32, thereby causing the conical portion 34 to be joined to the outer portion 32 of the brake.

Inner conical portion 34 includes a second end 76 that is diametrically wider than middle portion 74 and has an external diameter that is substantially the same as the external diameter of second end 48 of outer portion 32, as shown in FIGS. 3, 4 where inner conical portion 34 is shown received within outer portion 32. This matching of diameters permits inner conical portion 34 and outer portion 32 to have a seamless look, after the two components are joined and welded together, as shown in FIG. 4. That is, upon the press fitting of inner conical portion 34 within outer portion 32, the two portions are welded together at second end 48 of outer portion 32. Then, a blended weld is made at this location to give muzzle brake 30 a seamless look at this location. Again, as indicated above the inner portion and outer portions may be formed as a unitary or monolithic one-piece muzzle brake without the need to join the two components together.

Inner conical portion 34 defines a central, axially extending aperture 78 extending the length of inner conical portion 34. Central aperture 78 is sized to permit the bullet to travel through the inner conical portion.

In an exemplary embodiment, a series of crenellations 80 with pointed ends may be spaced-apart uniformly around second end 76 of inner conical portion 34. The crenellations may serve as a secondary line of defense during combat situations. Alternatively, the second end 76 may define a smooth flat surface with no crenellations.

Also positioned in a spaced apart manner around central aperture 78 is a baffle 82 that further includes a series of outer apertures 84, with outer apertures 84 having a diameter smaller than a diameter of central aperture 78. Baffle 82 serves to let the bullet pass through, but limits the amount of gases that can follow it. Baffle 82 further assists in limiting the recoil on firearm 5. Outer apertures 84 may be spaced equidistantly about central aperture 78 in a manner such that they are aligned with the plurality of spaced apart channels 72 formed on the outer surface of the inner conical portion 34. The channels 72 and apertures 84 provide a passageway for gases to escape forward of the muzzle brake. This has the benefit of greatly reducing the sound, i.e., decibel level, of the firearm after a round is fired. The sound is sent forward of the firearm and away from the operator and those standing next to or behind the operator. In addition to the apertures 84 taking the sound forward of the firearm, the apertures also relieve some of the great pressures within the pressure chamber to thereby maintain the integrity of the muzzle brake. In one embodiment, six outer apertures 84 are spaced equidistantly around central aperture 78, as shown in FIGS. 2-4 and 13. It is to be appreciated that other configurations for outer apertures 84 are possible with the disclosed muzzle brake 30.

In known operational fashion, the firearm bolt strips a cartridge from the magazine and moves the cartridge forward into barrel 18 as the bolt assembly moves toward a battery position. Once the bolt assembly is in the battery position, the user can activate the trigger. The trigger releases a cocked hammer and the hammer strikes a firing pin. The firing pin moves forward and makes contact with the cartridge. The contact between the firing pin and the cartridge causes the cartridge to fire and the resultant explosion forces a bullet out the end of barrel 18 along a forward path dependent on the direction barrel 18 is pointing. The propellant gases from the explosion are directed across the annular channels of the conical inner portion 34 and out toward ports 52, 54 and slots 60 formed on outer cylindrical portion 32. The location, design and orientation of ports 52, 54 and slots 60 along with the use of inner conical portion 34 defining annular channels cause the propellant gases to discharge from the end of barrel 18 in a manner that reduces recoil of firearm 5 and minimizes the rise and torqueing of barrel 18. The resultant explosion also causes the bolt assembly to recoil within the upper receiver and in a backward direction opposite of the direction of bullet travel. The movement of the bolt assembly allows the spent cartridge to be ejected. An operation spring opposes the backward travel of the bolt assembly and after the operation spring is sufficiently compressed, i.e., the bolt assembly is in a recoiled position, the compressed operation spring moves the bolt assembly forward so that another cartridge can be stripped from the magazine and the bolt assembly can be returned to the battery position.

It is to be understood that the invention is not limited in its application to the details of construction and the arrangement of the components set forth herein and illustrated in the drawings. The invention is capable of other embodiments and of being practiced or being carried out in various ways. Variations and modifications of the foregoing are within the scope of the present invention. It should be understood that the invention disclosed and defined herein extends to all alternative combinations of two or more of the individual features mentioned or evident from the text and/or drawings. All of these different combinations constitute various alternative aspects of the present invention.

What is claimed is:

1. A muzzle brake for a firearm comprising:

a substantially cylindrical hollow first portion having a first end and a second end, the first portion defining a longitudinal axis;

a pair of opposed rows of slots extending through the first portion, each row extending along a side of the first portion;

a pair of rows of ports extending through the first portion, each row extending axially along the first portion above one of the rows of slots, each of the ports are angled at approximately 45° with respect to the longitudinal axis of the first portion, wherein a forward-most port in each row of ports is angled outwardly and rearwardly toward the first end of the first portion, and every other port in each row is angled outwardly and forwardly toward the second end of the first portion;

a second portion having a first end received in the second end of the first portion, a second end, a central aperture extending axially through the second portion and being in fluid communication with the hollow first portion such that a bullet can pass through the first and second portions, the first end of the second portion defining a conical first end and defining a plurality of spaced-apart channels formed in an exterior surface of the conical first end, the plurality of spaced-apart channels extending axially along the exterior surface of the conical first end, wherein the second end of the second portion defines a plurality of outer apertures positioned about the central aperture, the plurality of outer apertures in fluid communication with the spaced-apart channels, and wherein the spaced-apart channels and plurality of outer apertures direct gases out through the outer apertures and past the second end of the second portion.

2. The muzzle brake of claim 1, wherein the slots are elliptical.

3. The muzzle brake of claim 2, wherein the elliptical slots have a major axis that extends substantially perpendicular with respect to the longitudinal axis of the first portion.

4. The muzzle brake of claim 1, wherein the slots extend through the first portion along a first longitudinal axis that is angled with respect to the longitudinal axis of the first portion.

5. The muzzle brake of claim 4, wherein the slots are angled at approximately 45° with respect to the longitudinal axis of the first portion.

6. The muzzle brake of claim 1, further comprising a plurality of crenellations extending axially outward from a peripheral edge of the second end of the second portion.

7. The muzzle brake of claim 1, wherein the first portion and the second portion are formed as a unitary, one-piece construction.

8. The muzzle brake of claim 1, further comprising an annular baffle located within the first portion and positioned near the first end of the first portion and defining a baffle surface that faces the first end of the first portion.

9. A firearm comprising:

a lower receiver;

an upper receiver mounted to the lower receiver, the upper receiver defining a receiver first end and a receiver second end;

a stock mounted to the receiver first end of the upper receiver;

a barrel mounted to the receiver second end of the upper receiver, and the muzzle brake according to claim 1 mounted to the barrel.

* * * * *